US005899133A

United States Patent [19]

Halladay et al.

[11] Patent Number: 5,899,133

[45] Date of Patent: May 4, 1999

[54] FROZEN HAMBURGER PATTY SEPARATOR

[75] Inventors: Gordon Halladay, Carteret; John Rinaldi, Old Bridge, both of N.J.

[73] Assignee: Frederick C. Eichler, Three Bridges, N.J.

[21] Appl. No.: 08/833,694

[22] Filed: Apr. 8, 1997

[51] Int. Cl.[6] ..... B26D 5/08

[52] U.S. Cl. ..... 83/608; 83/607; 83/467.1

[58] Field of Search ..... 83/467.1, 607–8, 83/932

[56] References Cited

U.S. PATENT DOCUMENTS

| | | | |
|---|---|---|---|
| 1,013,361 | 1/1912 | Barry | 83/608 X |
| 1,041,221 | 10/1912 | Wyatt | 83/608 X |
| 1,830,284 | 11/1931 | Massa | 83/608 X |
| 2,527,018 | 10/1950 | Luzzi | 83/608 X |
| 3,780,436 | 12/1973 | Pellman | 83/607 X |
| 4,811,642 | 3/1989 | Sorbie | 83/608 X |

*Primary Examiner*—M. Rachuba
*Assistant Examiner*—T. Anthony Vaughn
*Attorney, Agent, or Firm*—Ezra Sutton

[57] ABSTRACT

A frozen hamburger patty separator for separating a single hamburger patty from a frozen hamburger block including a U-shaped holding member having a bottom wall connected to front and rear walls for holding a frozen hamburger block in place. A U-shaped handle support component is connected to the holding member, and a blade support component is pivotally mounted on the handle support component. A separator blade is connected to the blade support component and is less than 2 inches from the pivotal mounting. A handle is connected to the blade support component for pivotally moving the separator blade between a separating position for separating hamburger patties from the frozen hamburger block and a non-separating position for allowing the frozen hamburger block to be moved along the holding member for holding the frozen hamburger block. The frozen hamburger patty separator is made of a material selected from the group consisting of durable plastic, steel, stainless steel, and aluminum for ease of cleaning and repeated use.

22 Claims, 6 Drawing Sheets

FROZEN HAMBURGER PATTY SEPARATOR

FIELD OF THE INVENTION

This invention relates to a novel and improved frozen hamburger patty separator for separating a frozen block of hamburger patties into individualized hamburger patties. More particularly, it relates to a hand-operated separator having a curved blade that instantaneously separates a patty from a frozen hamburger block having a plurality of hamburger patties that are frozen together.

BACKGROUND OF THE INVENTION

Consumers/cooks have great difficulty in trying to separate a round or square frozen block of hamburger patties using conventional utensils and tools such as knives, cleavers, screw drivers, chisels, metal wedges and the like. In trying to separate these frozen hamburger patties with the aforementioned conventional utensils and tools the user often injures his/her hands or fingers; and more often damages the individual hamburger patties such that the hamburger patty is marred, broken, contaminated and/or inedible, and not readily usable for frying, broiling, barbecuing, and the like.

Normal procedures have the frozen block of hamburger patties completely defrosted such that the individual hamburger patty is easily separated by a knife, spatula, hamburger flipper and the like. This procedure leads to many of the individual patties not being used for cooking, as these hamburger patties cannot be refrozen for sanitary reasons. In addition, these individual defrosted hamburger patties tend to break in half, become overly bloody and messy to handle; and again inedible and possibly contaminated and not readily usable for frying, broiling, barbecuing and the like. Thus, the consumer has wasted valuable food product for future use.

There remains a need for a simple, light-weight, portable hand-operated separator that will easily and quickly separate a single individualized hamburger patty from a frozen hamburger block having therein a plurality of individual hamburger patties that are frozen together without causing any injury to the user or causing any damage to the individualized hamburger patty that was separated from the frozen hamburger block.

DESCRIPTION OF THE PRIOR ART

Slicing, cutting and chopping devices for different types of food products having various designs, structures, configurations and materials of construction have been disclosed in the prior art. For example, U.S. Pat. Nos. 3,766,817; 3,961,551; 4,040,319; 4,262,565; 5,311,803; 5,355,588; 5,431,078 and 5,456,010 all disclose various slicing, cutting and chopping apparatus and devices for many types of food products such as cheese, butter, vegetables, fruits, meats and the like.

None of the aforementioned prior art patents teach or disclose the structure or configuration of a frozen hamburger patty separator having an operational mechanism which is simple in mechanical design for separating a single individualized hamburger patty from a frozen hamburger block by a user, as in the present invention.

Accordingly, it is an object of the present invention to provide a frozen hamburger patty separator that is hand-operated which is used for separating an individualized hamburger patty from a frozen hamburger block having therein a plurality of hamburger patties that are frozen together.

Another object of the present invention is to provide a frozen hamburger patty separator that has a separator blade having a concave cutting edge for easily and quickly separating a single patty from the frozen hamburger block.

Another object of the present invention is to provide a frozen hamburger patty separator that is simple in design, light-weight, portable, and easy to clean for repeated use.

Another object of the present invention is to provide a frozen hamburger patty separator that is easy to operate without causing any injury to the user or causing any damage to the individualized hamburger patty that was separated from the frozen hamburger block.

Another object of the present invention is to provide a frozen hamburger patty separator that is made of a durable, rigid plastic or made of a light-weight, durable metal such as stainless steel or aluminum for easy sanitary cleaning by the user.

Another object of the present invention is to provide a frozen hamburger patty separator that has a simple design configuration which includes a separator assembly having a handle mechanism for easily actuating the curved concave cutting edge of the separator blade into the frozen hamburger block in order to wedge apart a single patty from the frozen hamburger block.

A further object of the present invention is to provide a frozen hamburger patty separator that can be mass produced in an automated and economical manner, that is safe and easy to use, and is readily affordable by user.

SUMMARY OF THE INVENTION

In accordance with the present invention there is provided a frozen hamburger patty separator for separating a single hamburger patty from a frozen hamburger block including a U-shaped holding member having a bottom wall connected to front and rear walls for holding a frozen hamburger block in place. A U-shaped handle support component is connected to the holding member, and a blade support component is pivotally mounted on the handle support component. A separator blade is connected to the blade support component and is less than 2 inches from the pivotal mounting. A handle is connected to the blade support component for pivotally moving the separator blade between a separating position for separating hamburger patties from the frozen hamburger block and a non-separating position for allowing the frozen hamburger block to be moved along the holding member for holding the frozen hamburger block.

The frozen hamburger patty separator is made of a material selected from the group consisting of durable plastic, steel, stainless steel, and aluminum for ease of cleaning and repeated use.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
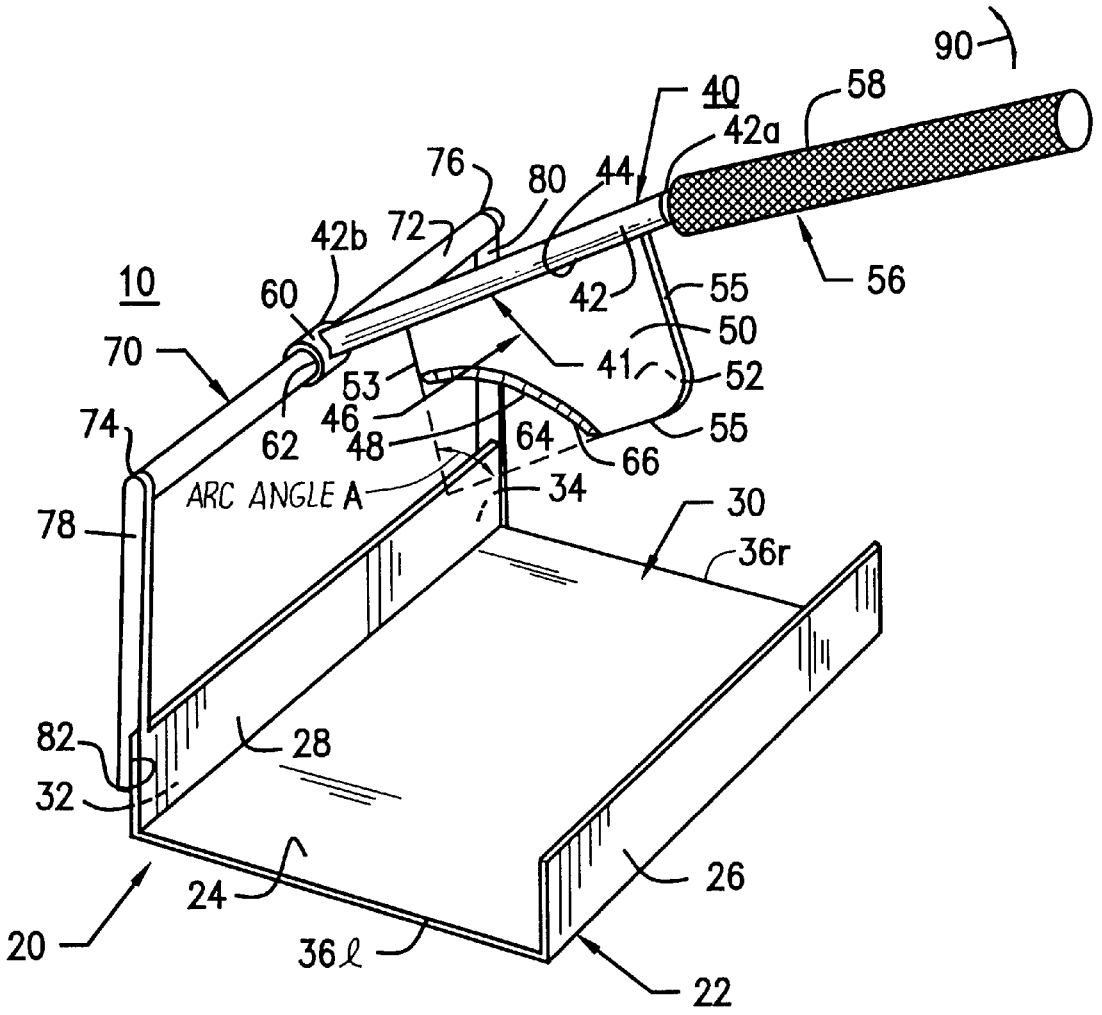
FIG. 1 is a front perspective view of the frozen hamburger patty separator of the preferred embodiment of the present invention showing the major component parts contained therein.
Figure 2:
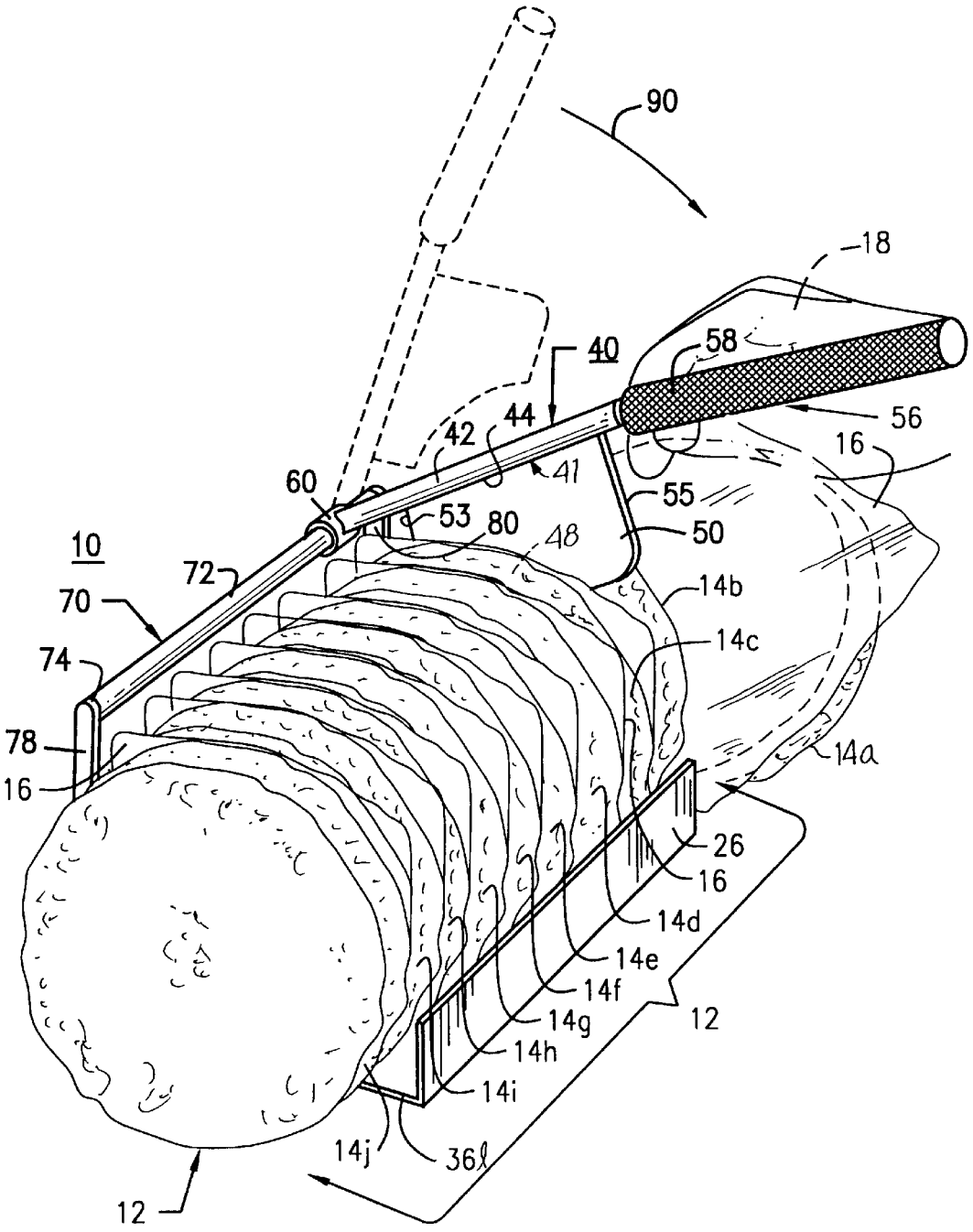
FIG. 2 is a front perspective view of the frozen hamburger patty separator of the preferred embodiment of the present invention showing the major component parts therein; and in operational use for separating a single hamburger patty from a frozen hamburger block.
Figure 3:
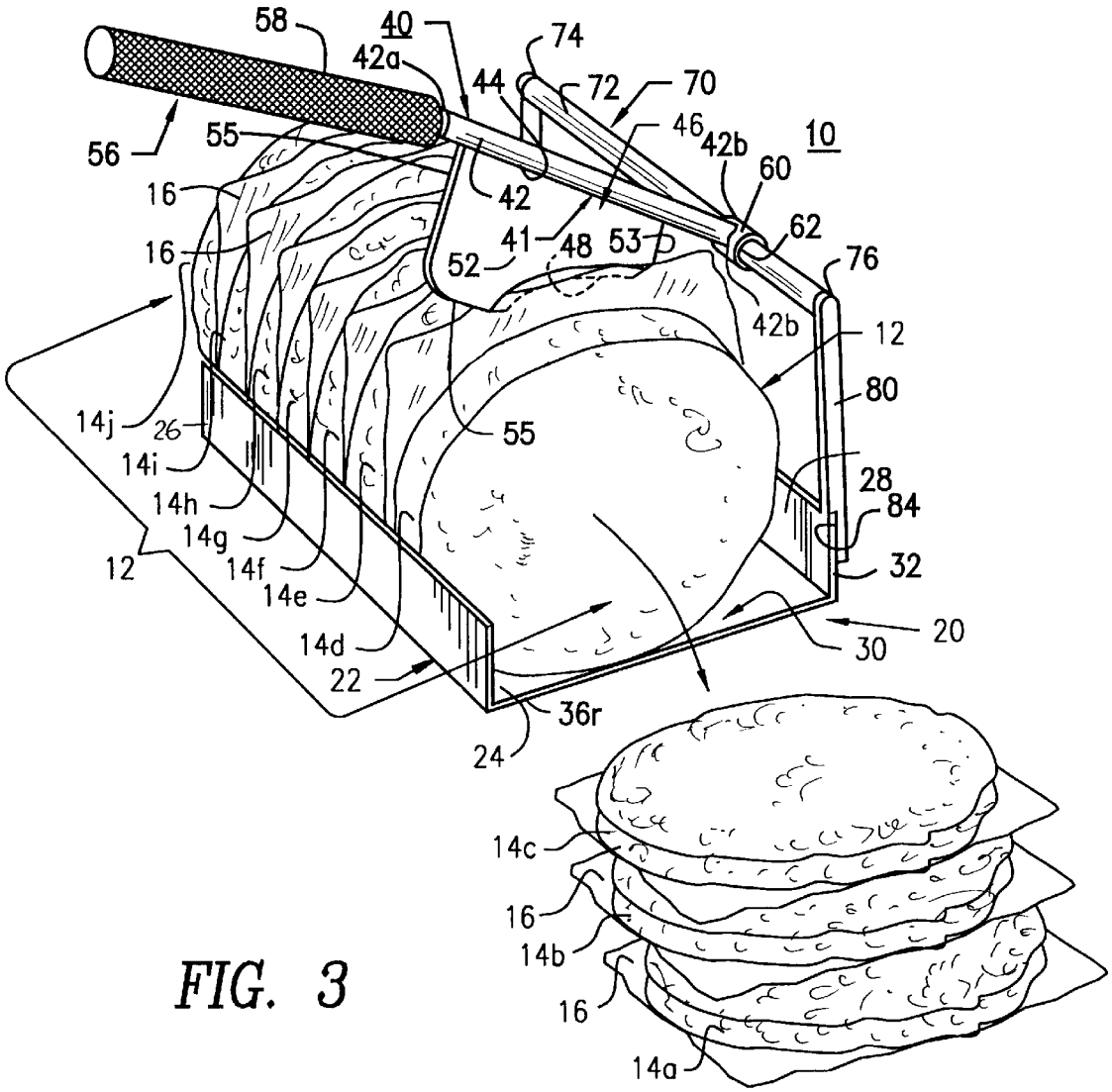
FIG. 3 is a front perspective view of the frozen hamburger patty separator of the preferred embodiment of the present invention showing the major component part therein; and in operational use for separating a plurality of individualized hamburger patties from a frozen hamburger block.
Figure 4:
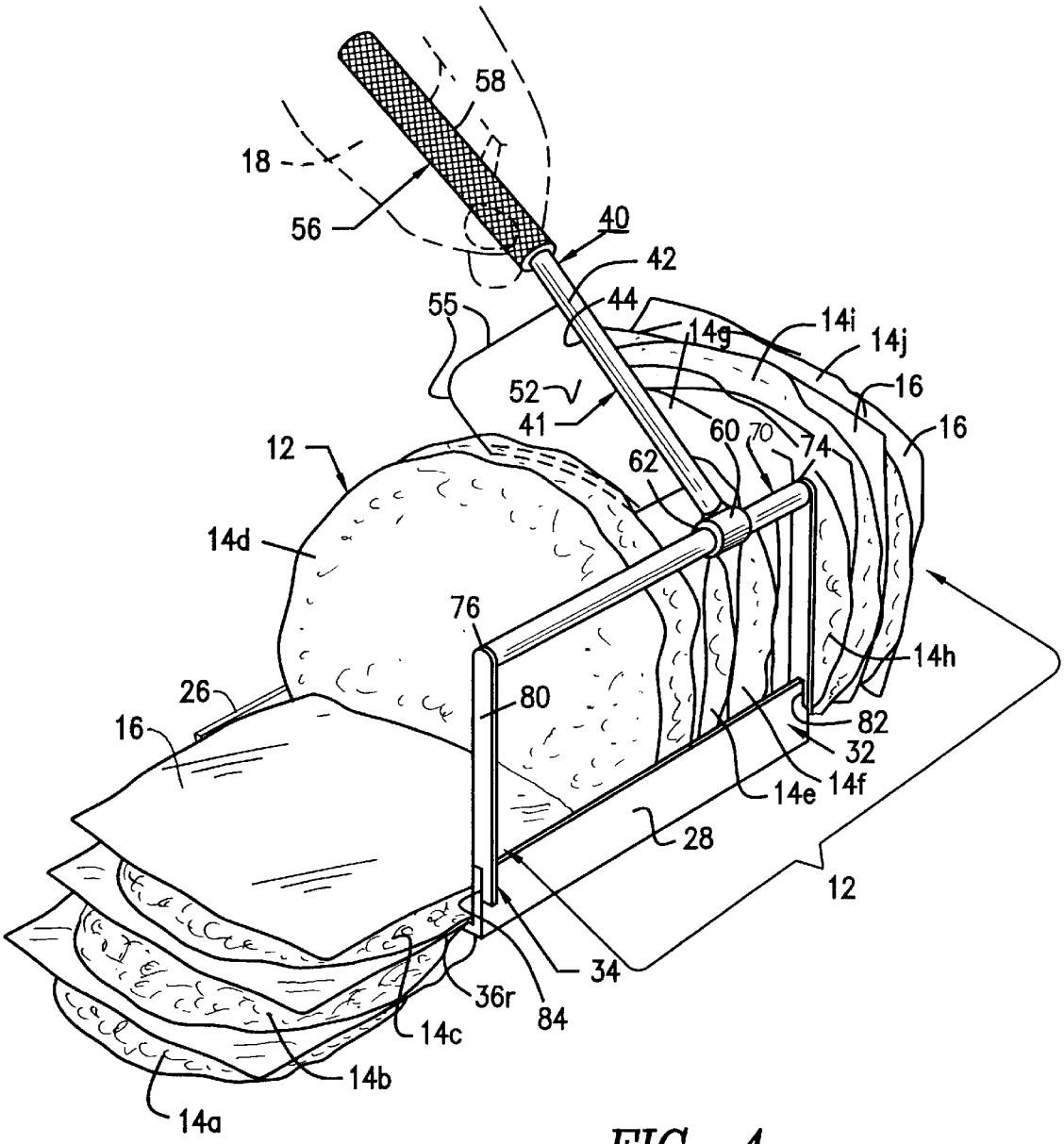
FIG. 4 is a rear perspective view of the frozen hamburger patty separator of the preferred embodiment of the present invention showing the major component parts contained therein; and in operational use for separating a single hamburger patty from a frozen hamburger block.
Figure 5:
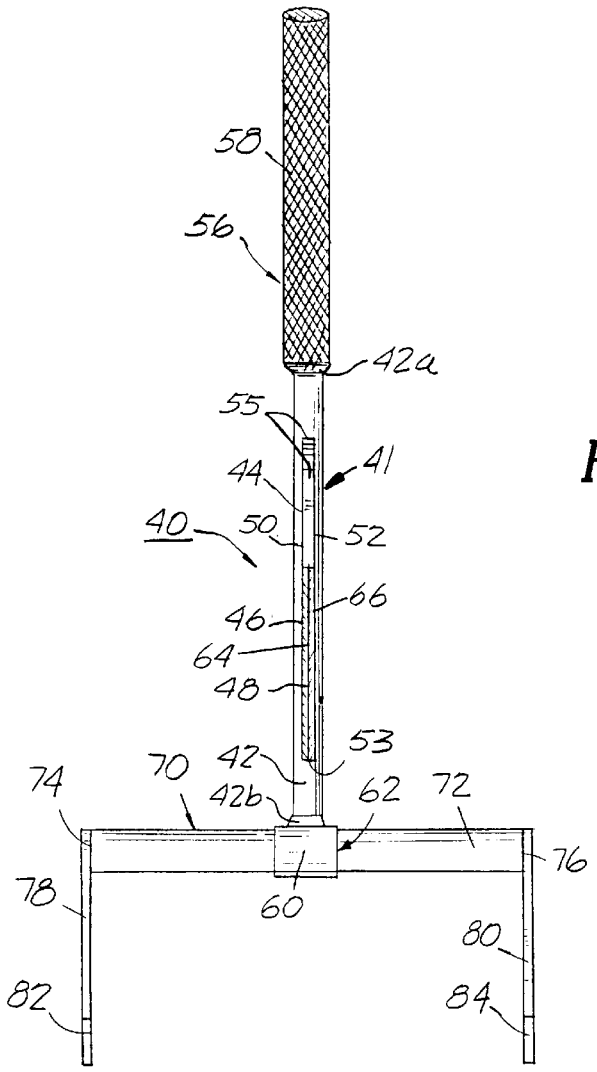
FIG. 5 is a bottom plan view of the frozen hamburger patty separator of the preferred embodiment of the present invention showing the separator assembly and its component parts contained therein.
Figure 6:
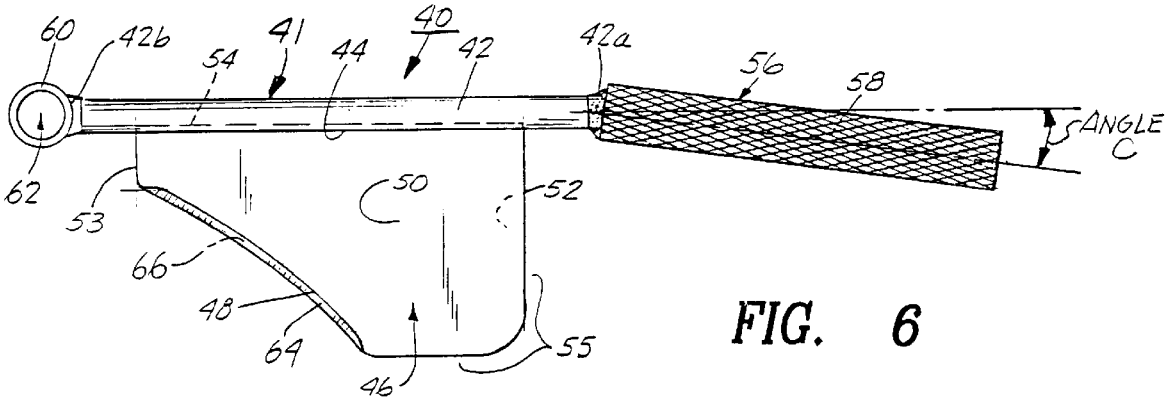
FIG. 6 is a side elevational view of the frozen hamburger patty separator of the preferred embodiment of the present invention showing the separator assembly and its component parts contained therein.

The frozen hamburger patty separator 10 and its component parts of the preferred embodiment of the present invention are represented in detail by FIGS. 1 through 6. The frozen hamburger patty separator 10, as shown in FIGS. 1 through 3, includes a holding member 20 for holding in place a frozen hamburger block 12 having therein a plurality of hamburger patties 14*a* to 14*j* frozen together with a paper separator 16 between each patty 14*a* to 14*j*, and a separator assembly 40 for separating a single hamburger patty 14*a* from the frozen hamburger block 12 by the downward motion 90 of the user's hand 18. FIGS. 2 to 4 in particular show the frozen hamburger patty separator 10 in operational use in which the user separates a single hamburger patty 14*a* from the frozen hamburger block 12 by the downward motion of the user's hand 18. Patty separator 10 may be made of a durable plastic, steel, stainless steel, or aluminum.

The frozen hamburger patty separator 10, as shown in FIG. 1, includes a holding member 20 having a holding housing 22 which holds the frozen hamburger block 12 in a horizontal and stable position in preparation for the separating of one hamburger patty. Holding housing 22 includes a bottom wall member 24 connected to front and rear wall members 26 and 28 which form an inner U-shaped channel 30. Bottom wall 24 further includes perimeter edges 36*l* and 36*r*.

The separator assembly 40, as shown in FIGS. 1 through 5, includes a blade support sub-assembly 41 and a handle support sub-assembly 70. Blade support sub-assembly 41 includes a cylindrical holding rod member 42 having an elongated U-shaped channel 44 for receiving a separator blade 46. Separator blade 46 includes a curved concave cutting edge 48, outer surface walls 50 and 52, with rear, top and front perimeter edges 53, 54 and 55. The concave cutting edge 48 has an arc angle A of 34° degrees with beveled edges 64 and 66 which are used for wedging the frozen patties 14*a* to 14*j* apart from the frozen hamburger block 12, as shown in FIGS. 2, 3 and 4 of the patent drawings.

Holding rod member 42 at one end 42*a* further includes an integrally connected cylindrical handle member 56 having a knurled outer surface 58 for gripping; and at the other end 42*b* an integrally connected cylindrical shaft attachment ring 60 having a circular hole opening 62 for receiving the cylindrical horizontal cross-bar member 72. Handle member 56 is slightly skewed downwardly from the horizontal of holding rod member 42 at a 7° degree angle, as shown by angle C in FIG. 5 of the drawings.

Separator assembly 40, as shown in FIGS. 1 and 4, further includes a U-shaped handle support sub-assembly 70 having a cylindrical horizontal crossbar member 72 with left and right end walls 74 and 76. Crossbar member 72 includes integrally attached vertical bar members 78 and 80 at end walls 74 and 76, respectively. Vertical bar members 78 and 80 each have an L-shaped notch 82 and 84 for attaching to the left and right rear wall outer surface corners 32 and 34 of rear wall 28. This aforementioned attachment of component parts connects the handle support component 70 to the holding member 20, as depicted in FIGS. 1 through 4.

Figure 7:
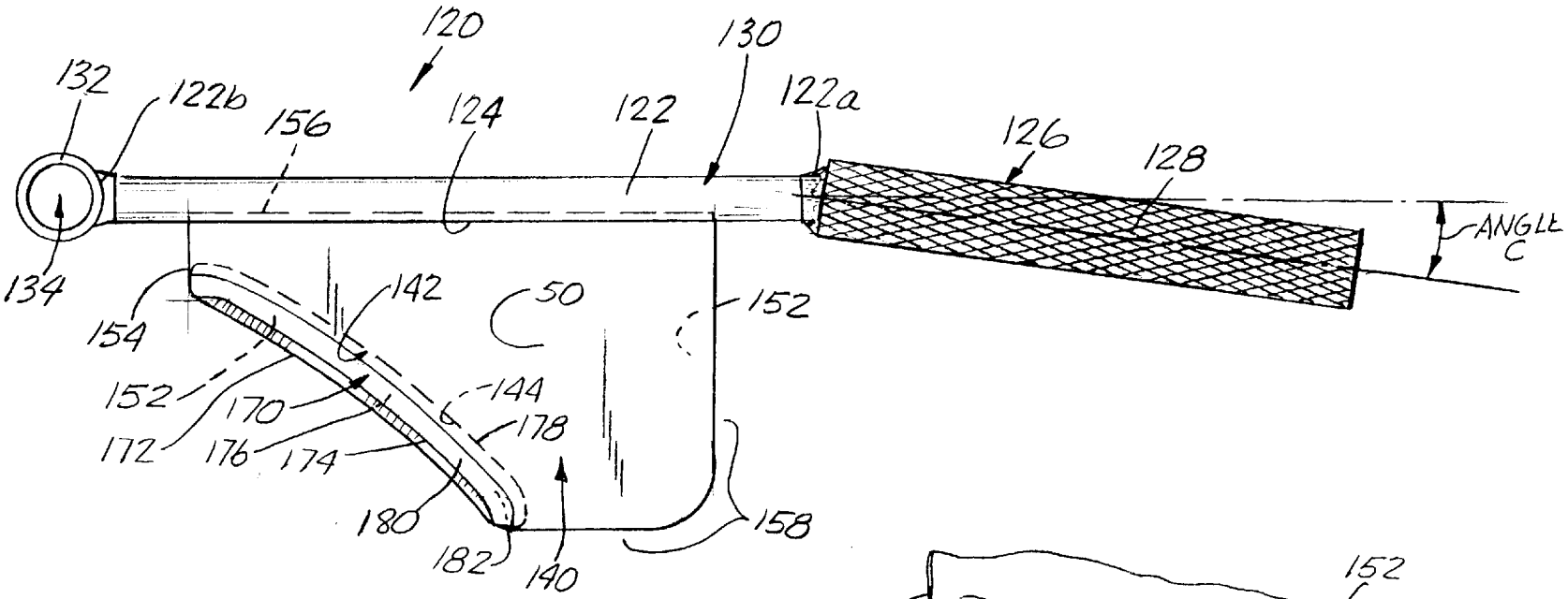
FIG. 7 is a side elevational view of the frozen hamburger patty separator of the present invention showing an alternate separator assembly.

The present invention of the frozen hamburger patty separator 10 includes an alternate separator assembly 120, as shown in FIG. 7 of the drawings. Alternate separator assembly 120 includes a cylindrical holding rod member 122 having an elongated U-shaped channel 124 for receiving a blade holder 140. Blade holder 140 includes an elongated, curved U-shaped channel 142 having a curved rear inner wall 144 for receiving a removable separator blade 170. Holding rod member 122 at one end 122*a* further includes an integrally connected cylindrical handle member 126 having a knurled outer surface 128 for gripping; and at the other end 122*b* an integrally connected cylindrical shaft attachment ring 132 having a circular hole opening 134 for receiving the cylindrical horizontal cross-bar member 72. Handle member 126 is slightly skewed downwardly from the horizontal of holding rod member 122 at a 7° degree angle, as shown by angle C in FIG. 7 of the drawings. Blade holder 140 further includes outer surface walls 150 and 152 with rear, top and front perimeter edges 154, 156 and 158. Top perimeter edge 156 of blade holder 140 is received within the elongated channel 124 of holding rod member 122 to form an integral separator blade holder 130 in which to hold slicer blade 170.

Figure 8:
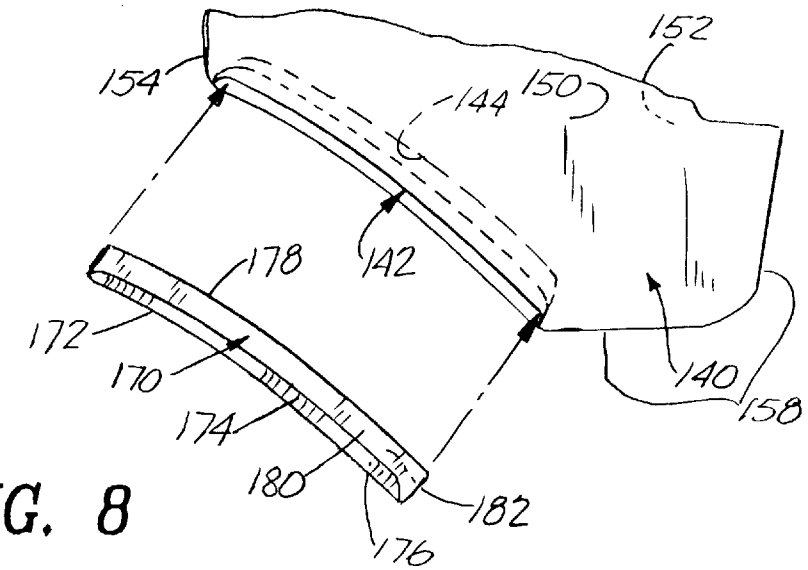
FIG. 8 is a bottom perspective view of the frozen hamburger patty separator of the present invention showing the alternate slicer blade being inserted into the separator blade holder of the alternate separator assembly.

Separator blade 170 includes a concave cutting edge 172 having an arc angle B of 34° degrees with beveled edges 174 an 176, a top curved perimeter wall 178 and outer blade walls 180 and 182. Curved perimeter wall 178 of separator blade 170 interfits into the U-shaped channel 142, such that curved perimeter wall 178 is adjacent and in contact with the curved rear inner wall 144. The alternate holding rod member 122, blade holder component 140, handle member 126 and shaft attachment ring 132 is made of a durable, rigid plastic material; and the separator blade 170 is made of a durable metal material, such as aluminum, steel, or stainless steel. This interfit forms the separator blade assembly 120, as shown in FIG. 8.

The physical dimensions of the frozen hamburger patty separator 10 is as follows: The holding member 20 measurements are that the bottom wall 24 has a width of four inches (4") and length of four inches (4"); front and rear walls 26 and 28 have a height of one inches (1") and a length of four inches (4"); with all wall thicknesses being one-sixteenth of an inch (1/16").

The separator assembly 40 and 120 measurements are that holding rod member 42 is four inches (4") in length and three-eights inches (3/8") in diameter and the integrally connected handle member 56 is three and one-fourth inches (3¼") in length and one-half inch (½") in diameter. The shaft attachment ring 60 is one-half inch (½") in width and one-half inch (½") in diameter with a circular opening 62 of thirteen-thirty seconds of an inch (13/32") in diameter; and holding rod member 42 is centrally located on shaft attachment ring 60 at end point 42*b*. The elongated U-channel receiving channel 44 for receiving separator blade 46 measures one-sixteenth inches (1/16") in width, three inches (3") in length and one-eighth of an inch (⅛") in depth. Separator blade 46 measures one and three-fourth inches (1¾") in height, three inches (3") in length and one sixteenth of an inch (1/16") in thickness with the curved concave cutting edge 48 having an arc length of two and one-sixteenth inches (2 1/16") and an arc angle A of 34° degrees. The curved edge has an arc angle A in the range of 30° to 40° degrees; and an arc length in the range of two inches (2") to two and one-eighth inches (2⅛").

The U-shaped separator holding member 70 has measurements such that the cylindrical horizontal cross-bar member is three and three-fourth inches (3¾") in length and three-eighths inches (⅜") in diameter with the integrally attached vertical bar members 78 and 80 being five-sixteenths inches (5/16") inches in width, two and three-eights inches (2⅜") in length and one-eight of an inch (⅛") in thickness.

In the alternate separator assembly 120 the separator blade holder 140 measures one and three-fourth inches (1¾") in height, three inches (3") in length, and one-sixteenth of an inch (1/16") in thickness with an elongated U-shaped channel 142 for receiving slicer blade 170 measures one-sixteenth of an inch (1/16") in width, two and one-sixteenth inches (2 1/16") in length, and one-eighth of an inch (⅛") in depth. Separator blade 170 measures one-fourth inches (¼") in width two and one-sixteenth inches (2 1/16") in arc length having arc angle B of 34° degrees, and three and sixty-fourths of an inch (3/64") in metal thickness.

OPERATION OF THE PRESENT INVENTION

In operation, the user places the frozen hamburger patty separator 10 on a sturdy counter top, table top and the like in preparation for use. As shown in FIGS. 2 and 3, the user then places a frozen hamburger block 12 within the inner U-shaped channel 30 of holding member 20, such that the first hamburger patty 14*a* to be separated from the frozen hamburger block 12 is positioned and adjacent to the bottom wall perimeter edge 36*r*. The frozen hamburger block 12 is kept in a stationary position (not being able to move in a forward or backward motion) as the front and rear wall members 26 and 28 prevent the frozen hamburger block 12 from a forward or backward movement.

The patty separator 10 is now ready to be used, such that the user takes the handle member 56 or 186 having a knurled surface 58 or 188 for gripping with his/or her hand 18 and positions the separator blade 46 or separator blade 170 over the first hamburger patty 14*a*. This positioning is allowed by the lateral movement of the shaft attachment ring 60 or 132 along horizontal cross-bar member 72 of separator holding member 70 via hole opening 62 or 134, such that the separator assembly 40 or 170 is in the proper position as depicted in FIGS. 2 and 3 of the drawings.

The user now places the concave curved cutting edge 48 or 176 of separator blade 46 or 170 between the first and second hamburger patties 14*a* and 14*b* having a paper separator 16 between frozen hamburger block 12, such that cutting or separating edge 48 or 176 is positioned to separate or wedge apart the hamburger patties 14*a* and 14*b* via the beveled edges 64 and 66 or 174 and 176 of separator blades 46 or 170. The user now is able to separate or wedge apart a single hamburger patty 14*a* from the adjacent hamburger patty 14*b* of frozen hamburger block 12 by the downward motion 90 of the user's hand 18 on handle member 56 or 186, as shown in FIGS. 2 and 3 of the drawings.

The user then shifts the separator assembly 40 or 120 along horizontal cross-bar member 72 of separator holding member 70 via hole opening 62 or 134 of shaft attachment ring 60 or 132, such that separator blade 46 or 170 is positioned between the next hamburger patties 14*b* and 14*c* of frozen hamburger block 12.

The aforementioned procedure is now repeated again in order to separate another single hamburger patty 14*b* from the adjacent hamburger patty 14*c* of frozen hamburger block 12 by another downward motion 90 of the user's hand 18 on handle member 56 or 186. This procedure is repeated by the user until all the hamburger patties 14*a* to 14*j* from frozen hamburger block 12 are individualized into single patties by the patty separator 10. The patty separator 10 is then washed and sanitized by the user for repeated use; and is easily stored away until its next use.

ADVANTAGES OF THE PRESENT INVENTION

Accordingly, an advantage of the present invention is that it provides for a frozen hamburger patty separator that is hand-operated which is used for separating an individualized hamburger patty from a frozen hamburger block having therein a plurality of hamburger patties that are frozen together.

Another advantage of the present invention is that it provides for a frozen hamburger patty separator that has a separator blade having a concave cutting edge for easily and quickly separating a single patty from the frozen hamburger block.

Another advantage of the present invention is that it provides for a frozen hamburger patty separator that is simple in design, light-weight, portable, and easy to clean for repeated use.

Another advantage of the present invention is that it provides for a frozen hamburger patty separator that is easy to operate without causing any injury to the user or causing any damage to the individualized hamburger patty that was separated from the frozen hamburger block.

Another advantage of the present invention is that it provides for a frozen hamburger patty separator that is made of a durable, rigid plastic or made of a light-weight, durable metal such as stainless steel or aluminum for easy sanitary cleaning by the user.

Another advantage of the present invention is that it provides for a frozen hamburger patty separator that has a simple design configuration which includes a separator assembly having a handle mechanism for easily actuating the curved concave cutting edge of the separator blade into the frozen hamburger block in order to wedge apart a single patty from the frozen hamburger block.

A further advantage of the present invention is that it provides for a frozen hamburger patty separator that can be mass produced in an automated and economical manner, that is safe and easy to use, and is readily affordable by user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A frozen hamburger patty separator for separating a single hamburger patty from a frozen hamburger block, comprising:

a) means for holding a frozen hamburger block; wherein said means for holding includes a bottom wall member connected to front and rear wall members for forming a U-shaped channel for engaging and holding in place the frozen hamburger block therein;

b) handle support means connected to said means for holding the frozen hamburger block; wherein said handle support means includes a U-shaped member having a horizontal cross-bar and vertical bar members being connected to said U-shaped channel;

c) blade support means including a holding rod member pivotally and slidably mounted on said horizontal cross-bar for slidably moving said holding rod member along said horizontal cross-bar; and wherein said holding rod member is arranged perpendicular to said U-shaped channel;

d) a separating blade connected to said holding rod member and being less than 2 inches from said pivotal mounting; and e) a handle connected to said holding rod member for pivotally moving said separating blade between a separating position for separating hamburger patties from the frozen hamburger block and a non-separating position for allowing the frozen hamburger block to be moved along said U-shaped channel for holding the frozen hamburger block.

2. A frozen hamburger patty separator in accordance with claim 1, wherein said frozen hamburger patty separator is made of a material selected from the group consisting of durable plastic, steel, stainless steel, and aluminum for ease of cleaning and repeated use.

3. A frozen hamburger patty separator in accordance with claim 1, wherein said vertical bar members are connected to said rear wall member.

4. A frozen hamburger patty separator in accordance with claim 1, wherein said holding rod member is circular, square or rectangular in shape.

5. A frozen hamburger patty separator in accordance with claim 1, wherein said holding rod member includes an elongated receiving channel for receiving said separating blade.

6. A frozen hamburger patty separator in accordance with claim 1, wherein said blade support means includes a shaft ring attachment for pivotally moving said blade support means between said separating and non-separating positions.

7. A frozen hamburger patty separator in accordance with claim 6, wherein said attachment shaft ring includes a hole opening for receiving said horizontal cross-bar member in order to laterally move said blade support means along said horizontal cross-bar for positioning said separator blade in relationship to the frozen hamburger.

8. A frozen hamburger patty separator in accordance with claim 1, wherein said handle includes a knurled outer surface for gripping.

9. A frozen hamburger patty separator in accordance with claim 1, wherein said handle is in the form of a rod.

10. A frozen hamburger patty separator in accordance with claim 1, wherein said handle is skewed downwardly from the horizontal of said holding rod member at a 7° degree angle.

11. A frozen hamburger patty separator in accordance with claim 1, wherein said separator blade includes a curved edge; said curved edge having an arc angle in the range of 30° to 40° degrees; and an arc length in the range of two inches (2") to two and one-eighth inches (2⅛").

12. A frozen hamburger patty separator in accordance with claim 1, wherein said separator blade further includes bevelled edges for separating a single hamburger from the frozen hamburger block.

13. A frozen hamburger patty separator in accordance with claim 1, wherein said separator blade is on a diagonal line relative to said blade support means.

14. A frozen hamburger patty separator in accordance with claim 1, wherein said separator blade is removably connected to said blade support means.

15. A frozen hamburger patty separator in accordance with claim 14, wherein said separator blade is removably connected and includes a curved or straight edge having bevelled edges for separating a single hamburger patty from the frozen hamburger block.

16. A frozen hamburger patty separator in accordance with claim 1, wherein said inner channel for holding in the place the frozen hamburger block therein has a length measurement of four inches (4"), a width measurement of four inches (4"), a height measurement of one inch (1") and a wall thickness measurement of one-sixteenth of an inch (1/16").

17. A frozen hamburger patty separator in accordance with claim 1, wherein said handle support means has a U-shaped member with a horizontal cross-bar that has a length measurement of three and three-quarter inches (3¾") with a diameter measurement of three-eights of an inch (⅜"); and vertical bar members having a width of five-sixteenths of inch (5/16"), a height of two and three-eights of an inch (2⅜"), and a wall thickness of one-eighth of an inch (⅛").

18. A frozen hamburger patty separator in accordance with claim 4, wherein said holding rod member has a length measurement of four inches (4") and a diameter measurement of three-eights of an inch (⅜").

19. A frozen hamburger patty separator in accordance with claim 9, wherein said handle has a length measurement of three and one-quarter inches (3¼") and a diameter measurement of one-half inch (½").

20. A frozen hamburger patty separator in accordance with claim 7, wherein said shaft ring attachment has a width measurement of one-half inch (½"), a diameter measurement of one-half inch (½"), a wall thickness measurement of one-sixteenth of an inch (1/16"), and a hole opening diameter measurement of thirteen-thirty seconds of an inch (13/32").

21. A frozen hamburger patty separator in accordance with claim 1, wherein said separator blade is connected to said blade support means and is less than one-half inch (½") from said pivotal mounting.

22. A frozen hamburger patty separator for separating a single hamburger patty from a frozen hamburger block, comprising:

a) a holding member having a bottom wall member connected to front and rear wall members to form a U-shaped channel for holding in place the frozen hamburger block therein;

b) a handle support assembly connected to said rear wall member of said holding member; said handle support assembly including a horizontal cross-bar member having left and right end walls;

c) a blade support component being pivotally mounted on said horizontal cross-bar member of said handle support assembly; said blade support component including a holding rod member having at one end a connected handle and having at the other end an attachment shaft ring for receiving said horizontal cross-bar member for laterally moving said blade support component along said horizontal cross-bar;

d) said holding rod member having an elongated receiving channel for receiving a separator blade; said separator blade connected to said holding rod member at distance of less than one-half inch (½") from said shaft attachment ring;

e) said separator blade having a curved concave wedging edge for inserting and wedging apart a single hamburger patty from a frozen hamburger block; and f) said handle for pivotally moving said separator blade between a separating position for separating hamburger patties from the frozen hamburger block and a non-separating position for allowing the frozen hamburger block to be moved along said holding member.

* * * * *